US006018892A

United States Patent [19]

Acheson et al.

[11] Patent Number: 6,018,892

[45] Date of Patent: Feb. 1, 2000

[54] INTERNAL COLLAR DEVICE FOR AN ARTICLE OF FOOTWEAR

[75] Inventors: Jeffrey J. Acheson, Weymouth; Todd D. Ellis, Boston, both of Mass.

[73] Assignee: Reebok International Ltd., Stoughton, Mass.

[21] Appl. No.: 08/923,460

[22] Filed: Sep. 4, 1997

[51] Int. Cl.[7] ..... A43B 7/20; A43B 5/16; A43B 5/04

[52] U.S. Cl. ..... 36/89; 36/115; 36/117.2; 36/117.6; 36/140

[58] Field of Search ..... 36/89, 115, 117.2, 36/117.6, 140, 92

[56] References Cited

U.S. PATENT DOCUMENTS

| | | | |
|---|---|---|---|
| 990,567 | 4/1911 | Krieger . | |
| 1,064,479 | 6/1913 | Healy . | |
| 1,522,256 | 1/1925 | Meyers . | |
| 1,692,896 | 11/1928 | Hilgert . | |
| 2,218,209 | 10/1940 | Marshall . | |
| 2,362,824 | 11/1944 | Hueston . | |
| 3,537,716 | 11/1970 | Norgiel . | |
| 3,807,062 | 4/1974 | Spier . | |
| 3,939,583 | 2/1976 | Daumann . | |
| 4,107,856 | 8/1978 | Bourque . | |
| 4,351,537 | 9/1982 | Seidel . | |
| 4,384,413 | 5/1983 | Bourque . | |
| 4,509,276 | 4/1985 | Bourque . | |
| 4,571,856 | 2/1986 | Lin et al. . | |
| 4,655,465 | 4/1987 | Schaeffer . | |
| 4,676,011 | 6/1987 | O'Rourke et al. . | |
| 4,766,681 | 8/1988 | O'Rourke et al. . | |
| 4,835,885 | 6/1989 | Hoshizaki et al. . | |
| 4,869,001 | 9/1989 | Brown . | |
| 5,038,762 | 8/1991 | Hess et al. . | |
| 5,105,565 | 4/1992 | Barret . | |
| 5,317,820 | 6/1994 | Bell et al. . | |
| 5,379,530 | 1/1995 | Bell et al. . | |
| 5,771,609 | 6/1998 | Messmer | 36/89 |
| 5,865,778 | 2/1999 | Johnson | 602/27 |
| 5,894,684 | 4/1999 | Sand et al. . | |

FOREIGN PATENT DOCUMENTS

| | | |
|---|---|---|
| 314901 | 5/1917 | Germany . |

OTHER PUBLICATIONS

Raichle Hard Shell Skiing/Snowboard Boots, 1995–1996 Catalogue.

I.L.R. 1998 Buyer's Guide.

K2 Snowboard Boots, 1996 Catalogue.

Solomon Cross–Country Ski Boots, 1995–1996 Catalogue.

Adidas Cross–Country Ski Boots, 1995–1996 Catalogue and 1995–1996 Adidas Cross–Country Skiing Technical Manual.

*Primary Examiner*—Ted Kavanaugh

*Attorney, Agent, or Firm*—Sterne, Kessler, Goldstein & Fox PLLC

[57] ABSTRACT

An internal collar device for an article of footwear. The internal collar device includes ankle wraps, a pivoting spine and a heel cup. The pivoting spine is a relatively narrow portion of the internal collar device which is flexible so that it pivots with the wearer's movement. The internal collar device is disposed in an external boot of the article of footwear so that the internal collar device pivots about a pivot axis near the wearer's malleoli. The article of footwear is configured so that internal collar device pivots almost entirely independently from the external boot. As such, the internal collar devices controls the forward and rearward flex of the wearer's ankle and provides support to the wearer's foot and ankle within the article of footwear. Further, forward and rearward flex of the wearer's ankle does not result in a crease or wear area forming in the external boot so that the present invention prevents premature wear of the boot material.

16 Claims, 4 Drawing Sheets

INTERNAL COLLAR DEVICE FOR AN ARTICLE OF FOOTWEAR

BACKGROUND OF THE INVENTION

1. Field of the Invention

The present invention relates to an internal collar device disposed in an article of footwear. In particular, the present invention relates to an internal collar device disposed in an external skate boot and configured to allow plantar flexion. More particularly, the present invention relates to an internal collar device for use in in-line skates.

2. Related Art

In many sports, such as skating, skiing, snow boarding, and basketball, a participant bends his knees to achieve an optimum position. When a participant bends at the knees, this movement lowers his center of gravity to provide added stability and to allow the participant to use additional power from his legs. This position naturally causes a forward flex movement of the lower legs and ankles of the participant. This movement requires sufficient plantar flexion. Many athletic shoes and boots constrict the wearer's ankle so that he cannot achieve an appropriate plantar flexion and forward flex of the ankle and lower leg to allow proper bending at the knees.

Those athletic shoes and boots which allow sufficient forward flex of a wearer's ankles are designed so that the boots bend in response to the wearer's movements. Portions of the boot material develop creases at the points of bending of the boots which result in breakdown of the boot material through repetitive bending of certain areas of the boots during normal use. The rigid form of the boots is often made in two parts such that they are hinged about a pivot point near the skater's ankle. Thus, the boots allow the wearer to flex forward in the boots.

In skating, in particular, bending of the skater's knees is critical to achieving an optimum skating position. Typically, ice skates and in-line skates have high-top skate boots which are buckled or laced around the skater's ankles. Conventional in-line skate boots are made from a relatively hard injection-molded plastic material, similar to a ski boot. This type of construction provides support for the wearer to prevent turning of the ankles.

A plastic boot, however, has several inherent disadvantages. For example, the boot, because of its stiffness, is often uncomfortable. Further, hard plastic boots are often difficult to ventilate properly, which results in overheating of the wearer's foot. This is particularly noticeable in a sport such as in-line skating, which is typically enjoyed mostly during warmer months.

In response to the disadvantages associated with hard plastic boots, a generation of relatively softer boots has evolved. These soft boots are typically made from a leather or synthetic material. Although the soft boots often provide a more comfortable fit for the wearer, in order to provide sufficient support for the wearer's ankle, they are often constructed to be semi-rigid, using stiffeners. Often, these soft boots, due to their inherent flexibility, allow the wearer to flex forward in the boots. However, this movement causes creases in the boots which result in premature breakdown of the boot material through normal use of the skate.

What is needed is an article of footwear which allows the wearer adequate plantar flexion while preventing premature breakdown of the boot material. In particular, what is needed is a skate boot which allows the wearer to achieve an optimum skating position without wear of the boot material. Further, such a boot should provide a comfortable fit for the wearer.

SUMMARY OF THE INVENTION

The present invention relates to an internal collar device disposed in an article of footwear, which allows the wearer adequate plantar flexion while preventing breakdown of the boot material. The article of footwear includes an external boot with an upper and a internal collar device. The internal collar device can be removably or permanently inserted into the external boot. The internal collar device includes ankle wraps, a pivoting spine and a heel cup. The pivoting spine is a relatively narrow piece of material that provides support to the wearer's foot and ankle while accommodating the wearer's forward and rearward flex movements.

Both the external boot and the internal collar device can be formed of a relatively hard or stiff core material and a relatively soft cover material. For example, the core material may be an injection molded plastic material for providing a semi-rigid structure to support the wearer's foot. The soft cover material provides a comfortable fit for the wearer by surrounding the relatively hard core material with cushioning.

The internal collar device may include a fastening system that is independent of the fastening system of the external boot, or it may be incorporated into the fastening system of the external boot. For example, the internal collar device may have an independent lacing, hook and pile, or buckle type fasteners attached to the ankle wraps to fasten the internal collar device about the wearer's ankle. On the other hand, the ankle wraps may have a set of holes formed thereon to accept laces from the external boot lacing system therein to fasten the internal collar device about the wearer's ankles.

In use, the internal collar device pivots about a pivot axis near the wearer's malleoli to control forward and rearward flex of the wearer's ankles. The internal collar device also pivots independently of the external boot such that creases and wear in the external boot due to forward flex are minimized. Thus, the present invention prevents premature breakdown of the external boot material.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

A preferred embodiment of the present invention is now described with reference to the figures where like reference numbers indicate identical or functionally similar elements. Further, although only one skate in a pair of skates is shown in the figures, the left and right skates are mirror images of each other. While specific configurations and arrangements are discussed, it should be understood that this is done for illustrative purposes only. A person skilled in the relevant art will recognize that other configurations and arrangements can be used without departing from the spirit and scope of the invention.

Figure 1:
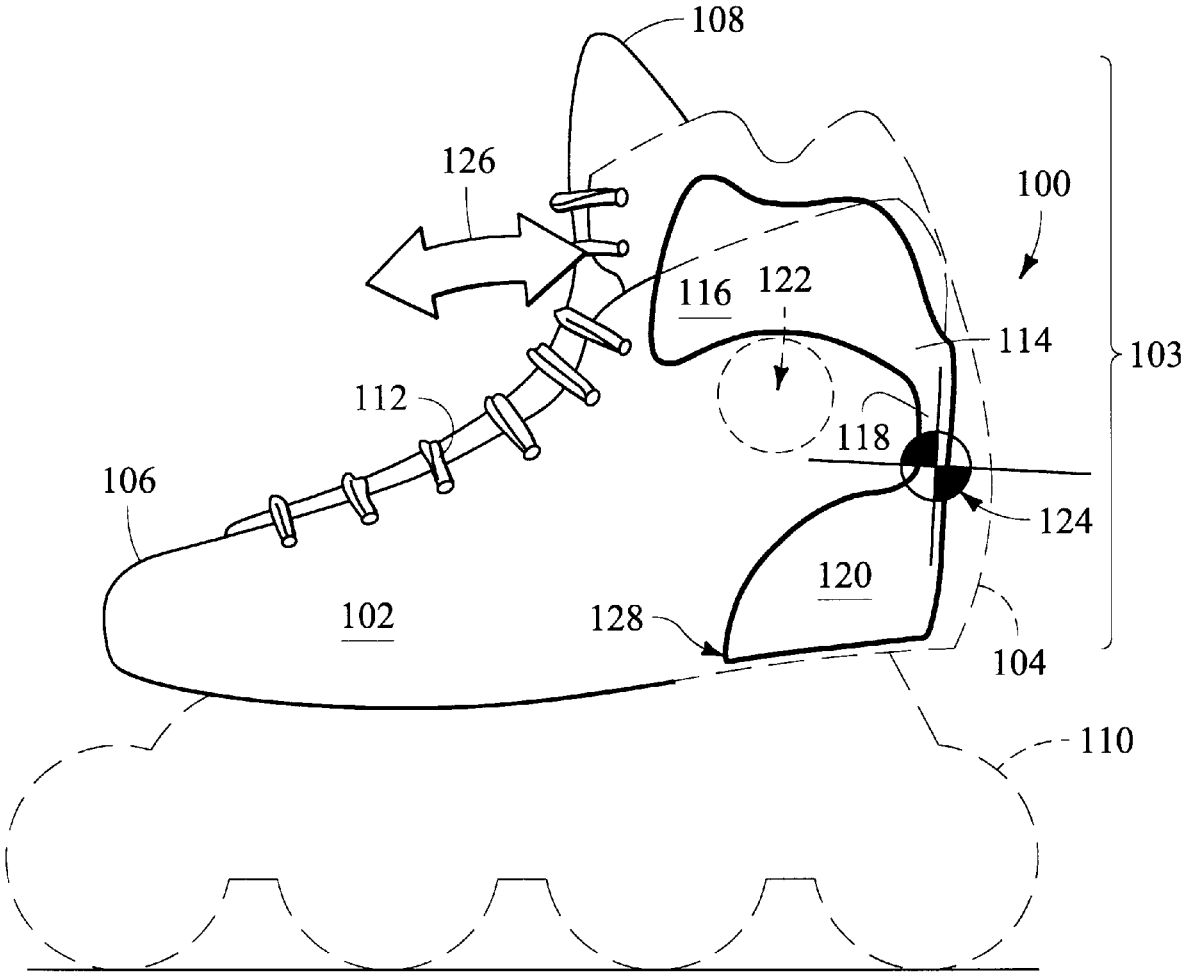
FIG. 1 shows a side plan view of a skate having an internal collar device of the present invention.

FIG. 1 shows an in-line skate 100. In-line skate 100 is shown by way of example only. The present invention is intended to be used with a variety of skate boots, such as ice hockey boots, figure ice skating boots, ice and in-line speed skating boots. Further, the present invention is intended to be used in other types of boots or shoes where forward flex of the wearer's ankle is desired, such as cross-country and downhill ski boots, snow board boots, hiking boots, high-top athletic shoes and other athletic footwear. Still further, the present invention can be used for medical or therapeutic braces, rehabilitation or corrective casts or splints, or surgical implants for joint or bone reconstruction. Still further, the present invention can be used in a variety of exercise equipment or human-powered vehicles.

Figure 4:
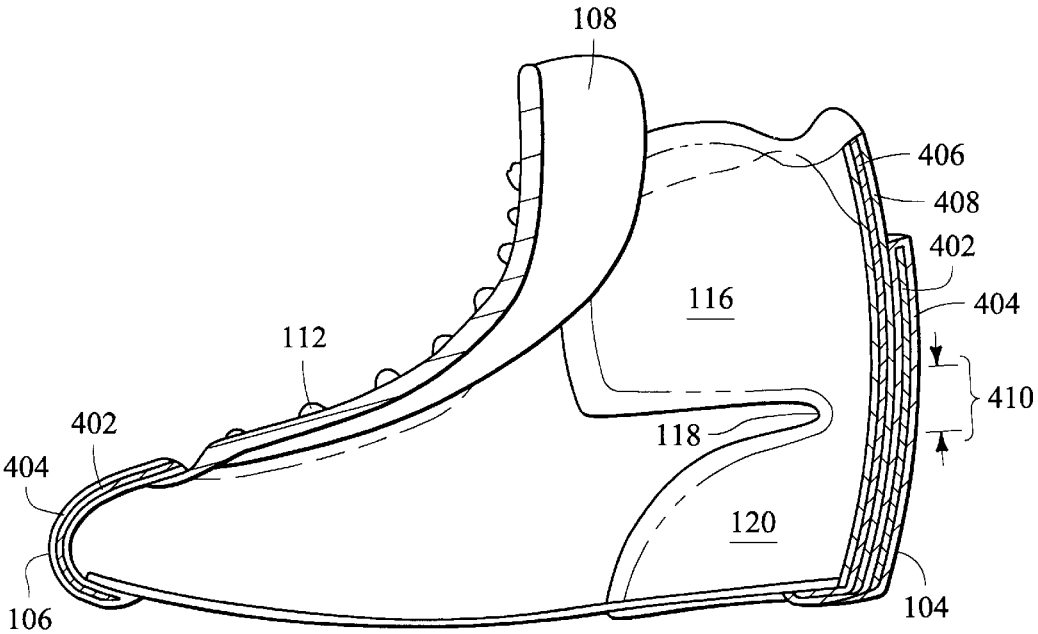
FIG. 4 shows a cross sectional, side view of the external skate boot and internal collar device of the present invention taken along a line 4—4 as shown in FIG. 3.

Skate 100 includes a rigid external boot 102. External boot 102 includes a heel portion 104, a toe portion 106, and a tongue 108. In one embodiment, external boot 102 includes stiffeners 402 and a cover material 404 to create a rigid or semi-rigid form, as shown in FIG. 4. Stiffeners 402 are made from a rigid material, such as, for example, injected or cut sheet plastic that is formed anatomically to fit a wearer's foot. In one embodiment, stiffeners 402 are constructed of a composite of rigid parts and are located in various areas of external boot 102 to provide support to the wearer's foot. For example, stiffeners 402 may be provided in heel portion 104 and toe portion 106 of external boot 102.

In an alternate embodiment, stiffeners 402 are an integrally and anatomically molded piece of rigid material that forms the shape of external boot 102. In either case, stiffeners 402 are surrounded by cover material 404 for the comfort of the wearer.

Cover material 404 is formed of a stitched or molded leather or synthetic material which is placed over a foam material. In an alternate embodiment, cover material 404 could be a single or multiple molded material, which is over molded onto stiffeners 402. The over molding materials comprise a variety of foamed or non-foamed plastics, including, ethylene-vinyl acetate (eva), polyvinyl chloride (pvc), polyurethane (pu), polyethylene (pe) or acrylonitrile-butadiene-styrene (abs).

In an alternate embodiment, external boot 102 is injection molded from a plastic material or made using other processes apparent to one skilled in the relevant art to form a relatively hard anatomic exterior shell. Such a hard boot could be integrally formed using a single piece of material or could be made using several separate injection molded or otherwise formed hard pieces of material.

FIG. 1 also shows a chassis and wheel combination 110 (in outline), disposed below external boot 102. External boot 102 may be rigidly attached to chassis and wheels 110 by gluing, screwing or other means apparent to one skilled in the relevant art. Any conventional chassis and/or wheels could be used for constructing an in-line skate which includes the present invention. Further, it would be apparent to one skilled in the relevant art how to make and use a chassis and wheels for an in-line skate. The wheels are shown in FIG. 1 as being aligned. It would be apparent, however, to one skilled in the relevant art that other wheel configurations could also be used.

Skate 100 also includes fastening means 112. As shown in FIG. 1, fastening means 112 comprises laces. Laces are an effective fastening means for soft boots, because the boots are flexible enough so that the wearer can tighten the boot around his foot using the laces to create a snug fit. A hook and pile type fastener could also be used to fasten external boot 102. Typically, buckles or similar fasteners are used as a fastening means on hard boots. Any of these fastening means would be sufficient for securing external boot 102 about the wearer's foot.

Skate 100 also includes an internal collar device 114 disposed within external boot 102. Internal collar device 114 includes ankle wraps 116, pivoting spine 118 and heel cup 120. Ankle wraps 116 provide additional support to a wearer's ankle and are anatomically formed to rest above or around the wearer's malleoli, the location of which is indicated by dotted line 122 in FIG. 1. Ankle wraps extend from heel portion 104 along the inside of both the lateral and medial sides of external boot 102 to tongue 108.

Figure 3:
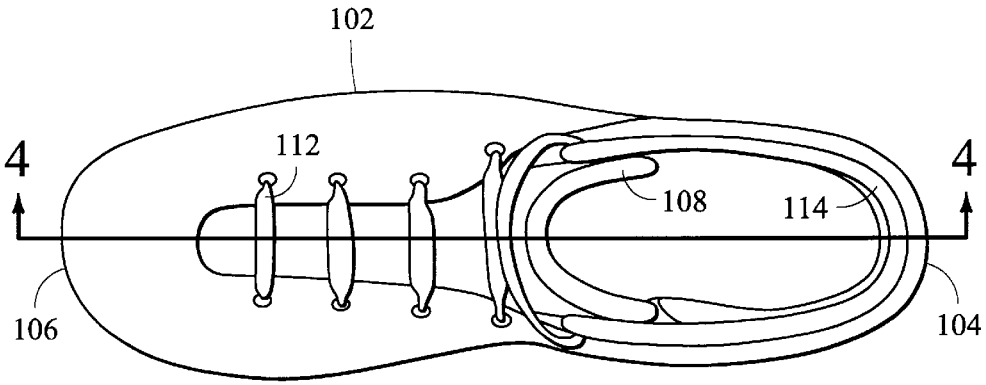
FIG. 3 shows a top view of the skate as shown in FIG. 1.

In one embodiment, a hole or several holes (not shown) are formed in the top portion of ankle wraps 116, so that fastening means 112 may be inserted therethrough, as shown in FIG. 3, to fasten internal collar device 114 and external boot 102 about the wearer's ankle. In an alternate embodiment, ankle wraps 116 include straps (not shown) extending therefrom, where the straps have a hook and pile or buckle fastening system. The straps are used to fasten internal collar device 114 about the wearer's ankle independently of the fastening means 112 for external boot 102. In another embodiment, internal collar device 114 includes a lacing system (not shown) which operates independently of fastening means 112 of external boot 102 to secure internal collar device 114 about the wearer's foot and ankle.

Pivoting spine 118 is a narrow strip of material that joins ankle wraps 116 and heel cup 120. In use, pivoting spine 118 rests in external boot 102 along the back of the wearer's foot adjacent heel portion 104. Pivoting spine 118 is designed to pivot with the wearer's movement about a pivot axis 124. In one embodiment, pivoting spine 118 is between approximately 10 and 25 mm in width at its widest point. Further, the length of a pivoting area 410, as shown in FIG. 4, is between approximately 10 and 35 mm. However, it would be apparent to one skilled in the relevant art that different widths and lengths can be used for pivoting spine 112 depending on the type of material used, the size of the shoe or boot in which internal collar package 114 is placed, and the desired flexibility of pivoting spine 118. If pivoting spine 118 does not have a narrow width, it will not pivot from the desired location, thereby impeding malleoli flex.

Figure 2:
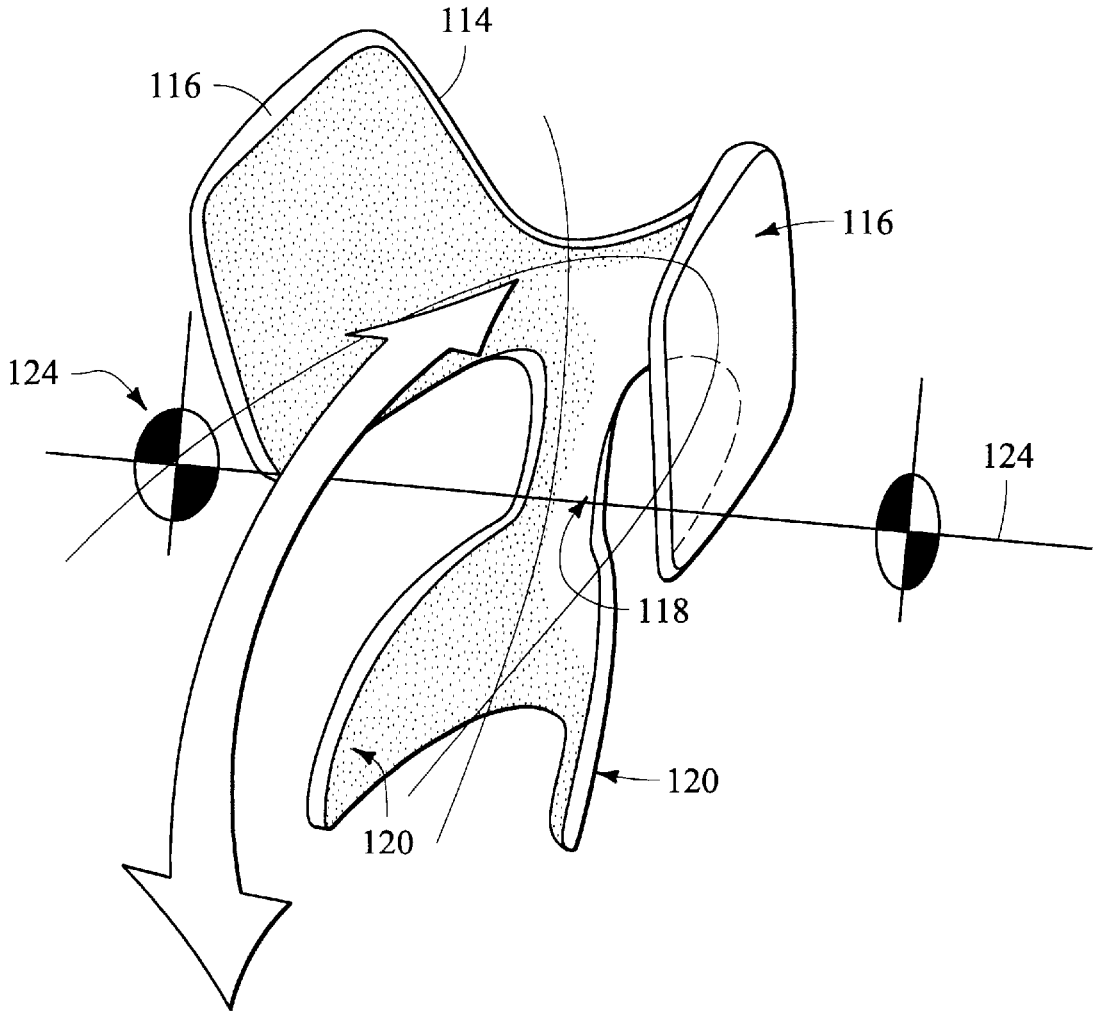
FIG. 2 shows a perspective side view of the internal collar device of the present invention.

As indicated by an arrow 126, (shown in FIGS. 1 and 2), pivoting spine 118 allows internal collar device 114 to flex forward and backward within external boot 102 to travel with and accommodate the wearer's movements. In one embodiment, pivot axis 124 is located adjacent and slightly behind and below the skater's malleoli. Thus, internal collar device 114 is designed to allow for controlled plantar and dorsi flexion of the ankle.

Heel cup 120 of internal collar device 114 provides correct heel placement and anatomic support for the wearer's heel to prevent movement of the heel and secures the heel within external boot 102.

In one embodiment, internal collar device 114 includes a core portion 406 and a cover portion 408, as shown in FIG. 4. Core portion 406 is made from rigid material, such as, for example, injected or cut sheet plastic that is formed anatomically to fit the user's foot and ankle. Core portion 406 can be formed as a single unitary piece or constructed of a composite of materials and/or parts, as would be apparent to one skilled in the relevant art.

Cover portion 408 is disposed over the exterior of core portion 406. In one embodiment, cover portion 408 is a stitched or molded leather or synthetic material which is placed over a foam material. In an alternate embodiment, cover portion 408 could be over molded onto core portion 406, including ankle wraps 116, pivoting spine 118 and heel cup 120. The over molding materials comprise a variety of foamed or non-foamed plastics, including, ethylene-vinyl acetate (eva), polyvinyl chloride (pvc), polyurethane (pu), polyethylene (pe) or acrylonitrile-butadiene-styrene (abs).

Internal collar device 114 can be incorporated into external boot 102 in a variety of ways. For example, in one embodiment, internal collar device 114 is constructed as a removable internal component that fits within heel portion 104 of external boot 102. In such an embodiment, a hook and pile type fastener (not shown) is used to connect a lower portion of heel cup 120 of internal collar device 114 to a lower portion 128 of external boot 102. In an alternate embodiment, heel cup 120 of internal collar device 114 is permanently fastened to lower portion 128 of external boot 102. For example, cover portion 408 could be stitched or glued to lower portion 128. It would be apparent to one skilled in the relevant art that a variety of methods could be used to fasten heel cup 120 to external boot 102.

In another embodiment, internal collar device 114 and external boot 102 are constructed as one homogeneous part, but each portion functions independently of the other. In particular, internal collar device 114 and external boot 102 could be molded as one integral piece such that a common last line around heel cup 120 of internal collar device 114 and lower portion 128 of external boot 102 form a hinge (not shown). Internal collar device 114 is rotated about the hinge into place within external boot 102 prior to attaching material for a footbed to external boot 102.

The mechanics of rigid external boot 102 provide the skater with medial and lateral support of the skater's foot and ankle. External boot 102 also guides the forward flex movement of the internal collar device 114 and limits backward flex movement of the skater's ankle to reduce the possibility of hyperextension of the ankle.

Internal collar device 114 of the present invention allows for controlled forward and backward flex movement of the skater's ankle by means of pivoting spine 118. This forward flex movement, along with the bending of the skater's knees, allows the skater to achieve an optimum skating position.

Figure 5:
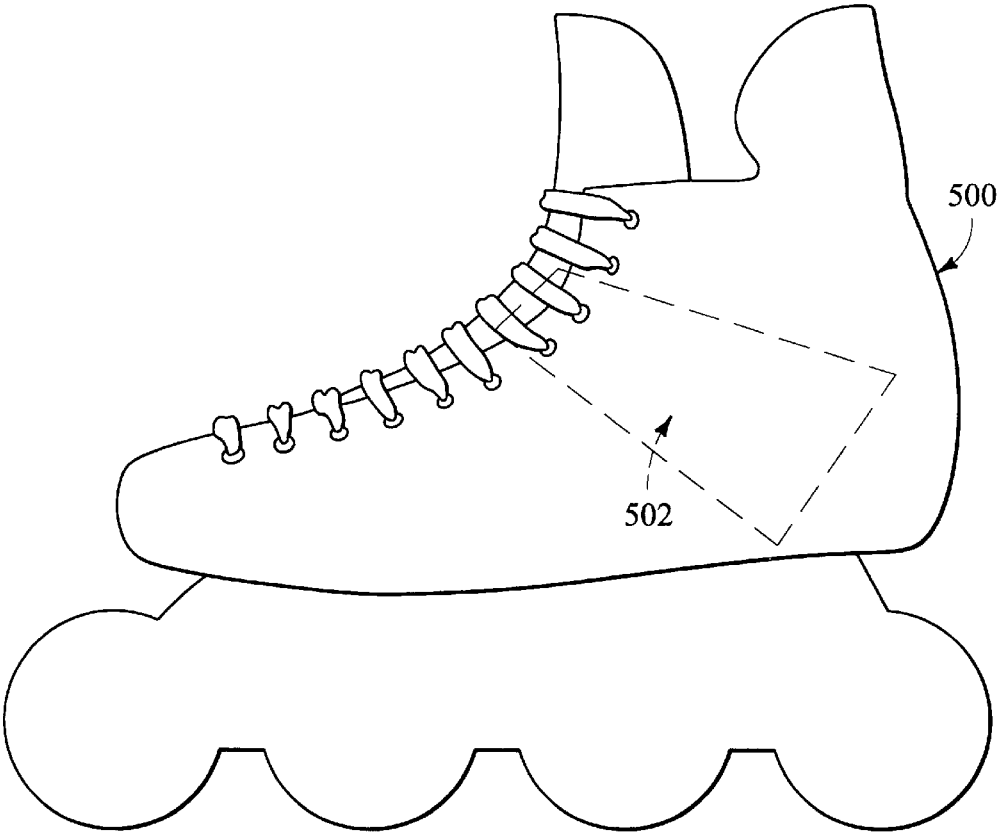
FIG. 5 shows a skate having a boot with an area in which wear or material breakdown generally occurs.

Further, the two-part construction of skate 100, including external 102 and internal collar device 104, minimizes breakdown of the boot upper. In a conventional skate boot, as shown in FIG. 5, a one-part construction is used. Conventional one-part upper construction is comprised of a single boot 500, which offers both forward ankle flex movement and medial and lateral support. Because this construction offers forward flex movement in the boot upper itself, a crease or wear area 502 occurs in the upper of boot 500 during normal use. This wear area 502 causes premature boot upper breakdown.

Internal collar device 114 provides a means for forward flex movement of the skater's ankle independent of the upper of external boot 102. In particular, pivoting spine 118 of internal collar device 114 is formed so that it flexes forward and backward independently external boot 102. This flex movement separate from external boot 102 minimizes breakdown of the upper of external boot 102.

While the invention has been particularly shown and described with reference to preferred embodiments thereof, it will be understood by those skilled in the art that various changes in form and details may be made therein without departing from the spirit and scope of the invention.

What is claimed is:

1. An article of footwear for accommodating malleoli flex, comprising:

an external portion having a heel portion and a toe portion; and an internal collar device disposed adjacent to said heel portion of said external portion, said internal collar device having a pivoting spine, a heel cup rigidly attached to a lower portion of said pivoting spine, and an ankle wrap rigidly attached to an upper portion of said pivoting spine, wherein said internal collar device pivots about a pivot axis independent of said external portion and said heel cup of said internal collar device is rigidly attached to said heel portion of said external portion.

2. The article of footwear of claim 1, wherein said heel cup of said internal collar device is formed integrally within said rigid external portion.

3. The article of footwear of claim 1, wherein said pivoting spine has a width between 10 and 25 millimeters at its widest portion.

4. The article of footwear of claim 1, wherein said pivoting spine has a length between 10 and 35 millimeters.

5. The article of footwear of claim 1, wherein said pivot axis is located adjacent to a wearer's malleoli.

6. The article of footwear of claim 1, wherein said internal collar device is formed as a unitary piece.

7. The article of footwear of claim 1, wherein said internal collar device is formed from a core material and a cover material.

8. The article of footwear of claim 7, wherein said core material is made from a rigid material that is formed anatomically to fit a wearer's foot and ankle.

9. An in-line skate having an internal collar package, comprising:

a rigid external skate boot having a heel portion and a toe portion; and a rigid internal collar device adjacent to said heel portion of said rigid external skate boot, said rigid internal collar device having a pivoting spine, a heel cup, and an ankle wrap wherein said pivoting spine and said ankle wrap pivot independent of said rigid external skate boot and said heel cup of said rigid internal collar device is rigidly attached to said heel portion of said rigid external skate boot.

10. The in-line skate of claim 9, wherein said heel cup of said rigid internal collar device is formed integrally within said rigid external skate boot.

11. The in-line skate of claim 9, wherein said pivoting spine has a width between 10 and 25 millimeters at its widest portion.

12. The in-line skate of claim 9, wherein said pivoting spine has a length between 10 and 35 millimeters.

13. The in-line skate of claim 9, wherein said rigid internal collar device is configured to pivot about a pivot axis located adjacent a wearer's malleoli.

14. The in-line skate of claim 9, wherein said rigid internal collar device is formed as a unitary piece of material.

15. The article of footwear of claim 9, wherein said heel cup is formed anatomically to fit a wearer's foot.

16. The article of footwear of claim 9, wherein said ankle wrap is formed anatomically to rest above or around a wearer's malleoli.

* * * * *